United States Patent [19]

Scheule et al.

[11] 4,173,456

[45] Nov. 6, 1979

[54] POLYOLEFIN/ACYLATED POLY(ALKYLENEAMINE) TWO COMPONENT FUEL ADDITIVE

[75] Inventors: Harold J. Scheule, Woodstown, N.J.; Roy E. Starn, Jr., West Chester, Pa.

[73] Assignee: E. I. Du Pont de Nemours & Co., Wilmington, Del.

[21] Appl. No.: 875,621

[22] Filed: Feb. 6, 1978

[51] Int. Cl.[2] ..... C10L 1/18; C10L 1/22

[52] U.S. Cl. ..... 44/62; 44/DIG. 1; 44/66; 44/73; 44/58

[58] Field of Search ..... 44/62, 58, 66, DIG. 1, 44/73

[56] References Cited

U.S. PATENT DOCUMENTS

| | | | |
|---|---|---|---|
| 3,502,451 | 3/1970 | Moore | 44/62 |
| 3,676,089 | 7/1972 | Morris et al. | 44/62 |
| 3,782,912 | 1/1974 | Machleder et al. | 44/66 |
| 3,785,789 | 1/1974 | Honnen et al. | 44/66 |
| 3,807,976 | 4/1974 | Polss | 44/62 |
| 3,838,991 | 10/1974 | Garth | 44/66 |
| 3,894,849 | 7/1975 | Polss | 44/66 |
| 3,901,665 | 8/1975 | Polss | 44/58 |
| 3,909,214 | 9/1975 | Polss | 44/58 |
| 3,944,397 | 3/1976 | Gardiner et al. | 44/58 |
| 3,948,619 | 4/1976 | Worrel | 44/58 |
| 4,015,952 | 4/1977 | Durand et al. | 44/62 |

OTHER PUBLICATIONS

"What Additives Do For Gasoline", Polss, *Hydrocarbon Processing*, Feb. 1973.

*Primary Examiner*—Winston A. Douglas
*Assistant Examiner*—J. V. Howard
*Attorney, Agent, or Firm*—James A. Costello

[57] ABSTRACT

Two component fuel additive compositions comprising a hydrocarbon-soluble, acylated, poly(alkyleneamine) and from 1 to 10 parts per part of said poly(alkyleneamine) of a normally liquid, hydrocarbon-soluble polymer of a $C_2$ to $C_6$ monoolefin or diolefin; also a concentrated hydrocarbon solution of said additive and a fuel composition containing an amount of said additive effective to provide carburetor detergency in spark-ignition engines.

15 Claims, No Drawings

POLYOLEFIN/ACYLATED POLY(ALKYLENEAMINE) TWO COMPONENT FUEL ADDITIVE

BACKGROUND OF THE INVENTION

1. Field of the Invention

This invention relates to two component acylated poly(alkyleneamine)/polyolefin fuel additive compositions which provide carburetor detergency and anti-icing protection in internal combustion engines.

2. Description of the Prior Art

Various operational difficulties are encountered with carburetors in spark-ignition, internal combustion engines. The difficulties include deposit accumulation on the carburetor throttle plate and on the surrounding walls. Such deposits interfere with the normal air flow in the carburetor and lead to fuel-rich mixtures which may cause rough idling and engine stalling.

Another operational difficulty is caused by an accumulation of deposits on the tulips of the intake valve. Such deposits can cause rough idling, loss of power and even valve burning. Another operational difficulty is caused by the accumulation of ice on the carburetor throttle plate under cold, humid conditions.

The art has provided additives to overcome one or all of the difficulties described supra. Known carburetor detergents include long-chain amines, amine phosphates, amides, aminoamides, and amine carboxylates. Some of these detergents are effective in cleaning a carburetor which already has accumulated deposits and in maintaining carburetor cleanliness. U.S. Pat. No. 3,894,849 discloses the acylated poly(alkyleneamines) employed in the two component additive of this invention as carburetor detergents (and anti-icing agents).

Additives to control intake valve deposits include top cylinder oils and low molecular weight polyolefins. U.S. Pat. No. 3,502,451, for example, discloses low molecular weight polymers of $C_2$ to $C_6$ olefins to control induction system deposits.

SUMMARY OF THE INVENTION

This invention concerns a multifunctional gasoline additive composition comprising (i) a hydrocarbon-soluble, acylated, poly(alkyleneamine) of the formula $$R^1-\overset{\overset{\displaystyle O}{\|}}{C}-\overset{\overset{\displaystyle H}{|}}{N}-(C_nH_{2n}\overset{\overset{\displaystyle R}{|}}{N})_xH$$

wherein

R is selected from at least one of H and R′—C(O)—;

$R^1$ is $C_9$ to $C_{23}$ hydrocarbyl;

n is 2, 3, or a mixture of 2 and 3; and x is 2 to 6; and (ii) from about 1 to 10 parts per part of said poly(alkyleneamine) of a normally liquid, hydrocarbon-soluble polymer of a $C_2$ to $C_6$ olefin, said polymer having an average molecular weight of about 400 to 3000.

Preferred compositions are those wherein at least two R groups are R′—C(O)—; R′ is a $C_9$ to $C_{21}$ hydrocarbyl; n is 2 or 3; x is 4; and the polymer is polypropylene having an average molecular weight of about 500 to 1000 in an amount of about 3 to 8 parts of said polymer per part of poly(alkyleneamine).

This invention also concerns an additive composition comprising from 30% to 75% by weight of the two component additive, (i) and (ii), and from 25% to 70% of a hydrocarbon solvent therefor. This invention also concerns a fuel composition containing an effective amount of said two component additive.

Normally, the acylated poly(alkyleneamine) is used in an amount to provide from about 0.0004% by weight based on the gasoline (1 pound per thousand barrels, ptb) to 0.04 percent by weight (100 ptb) and the hydrocarbon polymer is used in an amount to provide from 0.0004% by weight (1 ptb) to 0.2% by weight (500 ptb). Preferably, the poly(alkyleneamine) is used in the range of 0.0008 weight percent (2 ptb) to about 0.02 weight percent (50 ptb) and the hydrocarbon polymer is used in the range of about 0.004 weight percent (10 ptb) to 0.08 weight percent (200 ptb).

DETAILS OF THE INVENTION

Component (i)

The acylated poly(alkyleneamine) component can be fully acylated, that is, each nitrogen atom of the polyamine can have an acyl substituent; or, the polyamine can be partially acylated, that is, some of the nitrogen atoms of the polyamine can have acyl substituents. Poly(alkyleneamines) useful for the preparation of component (i) are $$H_2N-(C_nH_{2n}NH)_xH$$

wherein n and x are as defined above. It should be understood that when n is three, $C_nH_{2n}$ can be either a 1,2 or 1,3-propylene group.

The poly(alkyleneamines) and their preparation are well known in the art. For example, one preparation comprises reacting an appropriate alkylene dihalide and ammonia. Representative of useful poly(alkyleneamines) are diethylenetriamine, triethylenetetramine, tetraethylenepentamine, pentaethylenehexamine, dipropylenetriamine, tripropylenetetramine, tetrapropylenepentamine, and pentapropylenehexamine, all of which are commercially available. Mixtures of poly(alkyleneamines) can also be used to prepare the acylated poly(alkyleneamines). Poly(ethyleneamines) are preferred because of their greater availability. Certain commercial grades of poly(ethyleneamines) which contain cyclic homologues such as N-aminoethyl piperazine and N,N′-bis(aminoethyl)piperazine can also be used.

As mentioned heretofore, the value of n in the poly(alkyleneamine) can have a single value of 2 or 3 or can be a mixture of 2 and 3. In the above-described poly(ethyleneamine) n has a value of 2 whereas in the poly(propyleneamine) n has a value of 3. Poly(alkyleneamines) having a mixture of n values of 2 and 3 are readily prepared by methods known in the art. Thus, ethylenediamine such as $NH_2C_2H_4NH_2$, can be reacted with two moles of acrylonitrile, $CH_2{=}CHCN$, to provide a dinitrile such as, $CN-C_2H_6NHC_2H_4NHC_2H_6CN$, which upon reduction by, say, catalytic hydrogen will provide a poly(alkyleneamine) such as, $NH_2-C_3H_6-NH-C_2H_4N-H-C_3H_6NH_2$, wherein the compound has a mixture of n values of 2 and 3.

The poly(alkyleneamines) can be acylated by reaction with a carboxylic acid of the formula, $R^1COOH$, wherein $R^1$ is as defined above, or an anhydride or an acid halide of such carboxylic acid by procedures well known in the art. The following disclosure is provided in terms of a carboxylic acid; it is to be understood, however, that an anhydride or an acid halide can be employed in an analogous manner as will be appreciated by one skilled in the art.

The carboxylic acid used to acylate the polyamine is a hydrocarbon monocarboxylic acid of 10 to 24 carbon atoms; it can be branched- or straight-chain, saturated or unsaturated and may have an aryl substituent. Included are alkanoic, alkenoic and alkadienoic acids.

Representative carboxylic acids include decanoic, decenoic, dodecanoic, dodecenoic, tridecanoic, tridecenoic, tetradecanoic, tetradecenoic, hexadecanoic, hexadecenoic, octadecanoic, octadecenoic, octadecadienoic, eicosanoic, eicosedienoic, eicosatrienoic, doeicosanoic as well as phenyl-substituted carboxylic acids such as phenylstearic acid. It will be understood that the above-recited acids include both branched- and straight-chain acids.

Mixed acids can be employed, the mixture being preferred because of generally lower cost and better properties of fluidity and greater solubility. Acid mixtures such as those obtained by hydrolysis of natural fats and oils are useful. Included are those derived from coconut oil, corn oil, cottonseed oil, tallow and soybean oil. The acids prepared from tallow are ordinarily mixtures of tetradecanoic, tetradecenoic, hexadecanoic, hexadecenoic, octadecanoic, octadecenoic, octadecadienoic and eicosanoic acids; those prepared from soybean oil are mixtures containing hexadecanoic, octadecanoic, octadecadienoic and eicosanoic acids; those prepared from cotton seed oil are mixtures ordinarily containing tetradecanoic, hexadecanoic, octadecanoic, octadecadienoic and eicosanoic acids; and those prepared from coconut oil contain decanoic, dodecanoic, tetradecanoic, hexadecanoic, octadecanoic, octadecenoic and octadecatrienoic acids with a small amount of octanoic acid.

A particularly useful acid mixture is tall oil fatty acid obtained from tall oil. Tall oil is a mixture of rosin and fatty acids released by acidulation of the black liquor soap skimmed off the black liquor from the sulfate process in the manufacture of Kraft paper. Crude tall oil is commonly fractionally distilled to provide various cuts wherein the ratio of fatty acids to rosin acids varies from 1:99 to 99:1. In the context of this description, tall oil fatty acid is intended to include tall oil compositions having a fatty acid content of at least about 50% by weight, the balance being mainly rosin acids in admixture with minor amounts of unsaponifiable materials of unknown chemical composition. The fatty acids in tall oil fatty acids consist mainly of oleic, linoleic, conjugated linoleic, palmitic, stearic, palmitoleic, arachidic and behenic acids. Tall oil fatty acids which are commercially available include those with the following compositions: palmitic (0.1 to 5.3%); palmitoleic (0.1 to 2.1%); stearic (2.1 to 2.6%); oleic (39.3 to 49.5%); linoleic (38.1 to 41.4%); eicosanoic (1.2 to 1.9%); eicosadienoic (0.5 to 3.2%); eicosatrienoic (0.4 to 2.9%); and behenic (0.4 to 0.9%) acids, with the balance being rosin acids, unidentified acids and unsaponifiable materials.

With a carboxylic acid as the acylating agent, it is preferred to react the carboxylic acid and the polyamine at 70° to 200° C. in the absence of any solvent, and to remove no more than about one mole of condensation water for each mole of the acid reacted. The ratio of the carboxylic acid to the polyamine used in the reaction depends upon the particular polyamine used and the particular product desired. It can vary from one mole of the carboxylic acid per mole of the polyamine to one mole of the acid per gram atom of nitrogen per mole of the polyamine. The preferred acylated poly(alkyleneamine) is prepared from fatty acid and tetraethylenepentamine reacted in the molar ratio of 3:1.

When an anhydride is used as the acylating agent, the anhydride is mixed with the amine and the mixture is heated slightly. If preferred, a catalyst, such as pyridine, can be used. When an acid halide is the acylating agent, the acylation can be carried out in the presence of aqueous alkali according to the well known Schotten-Baumann reaction.

Component (ii)

The hydrocarbon-soluble polymers are polymers of average molecular weight of about 400 to 3000 prepared from monoolefins and diolefins of two to six carbon atoms. The polymer can be a homopolymer or a copolymer. Mixtures of polymers with the average molecular weight falling within the above-described range can also be used. Polymers prepared from propylene and butylene are preferred. The preferred polypropylene will have an average molecular weight in the range of 500 to 1200, more preferably 600 to 1000. In the above range of molecular weight, polypropylenes are liquids at normal temperatures, have 100° F. SUS viscosities of about 2,000 to 70,000 and are highly soluble in hydrocarbons.

The preferred polybutylenes are polyisobutylenes having average molecular weights in the range of 950 to 1400. Such polyisobutylenes are liquids at normal temperatures, have 100° F. SUS viscosities of about 40,000 to 125,000 and are highly soluble in hydrocarbons.

The molecular weights referred to herein are number average molecular weights as determined by vapor pressure osmometry (ASTM-D 2503). SUS viscosity is determined according to ASTM-D 445-446.

An important advantage of this invention is that only small amounts of the additive are necessary to provide significant carburetor detergency, and carburetor icing protection. The actual quantities depend upon the particular fuel and its tendency to form deposits as well as the degree of performance desired.

The two components, (i) and (ii), can be added separately, or in combination. For ease of handling, they can be added as a concentrate in a suitable carrier such as liquid hydrocarbon. Suitable solvents include those boiling in the gasoline and light hydrocarbon range such as hexane, isooctane, kerosene, toluene and xylene. The concentrate can also contain other additives normally added to gasoline such as corrosion inhibitors and dehazing agents which enhance the fuel-water separation characteristics. Typically, a concentrate will contain, in addition to the additive of this invention, about 0.25 to 3 weight percent of a corrosion inhibitor and about 0.25 to 3 weight percent of a dehazing agent. Corrosion inhibitors and dehazing agents useful in gasolines are well known and available commercially.

Fuels into which the additives of the present invention are incorporated are normally mixtures of hydrocarbons boiling in the gasoline range, normally about 35° C. to 220° C. They can consist of straight-chain or branched-chain alkanes, cycloparaffins, olefins are aromatic compounds or any mixture of such hydrocarbons obtainable from straight run naphtha, polymer gasoline, natural gasoline, thermally or catalytically cracked hydrocarbon stocks and catalytically reformed stocks.

The gasoline can also contain conventional additives such as antiknock compounds, dyes, antioxidants, anti-icing agents, rust inhibitors as well as nonvolatile lubricating mineral oils also known as top cylinder oil which may be a paraffinic or naphthenic oil or a mixture thereof having a viscosity at 100°F. of 500 to 3500 SUS.

EXAMPLES

The effectiveness of the composition of this invention in keeping a carburetor clean (carburetor detergency) was demonstrated in a carburetor keep-clean test (Onan) carried out in a single cylinder engine to which a controlled amount of exhaust gas from another engine was added with the air supplied to the test carburetor. The test carburetor throat consisted of a two-piece stainless steel liner fitted around the throttle plate shaft. The liner was removed for inspection and rating. The engine was operated under cycling conditions of one minute idling and three minutes part throttle over a two-hour test period. A visual rating of 10 for a clean carburetor and 0 for a dirty carburetor was used. A rating of 7 or greater is considered good detergency.

EXAMPLES 1 TO 5 (AND COMPARISONS A AND B)

The acylated poly(alkyleneamine) was a triamide of tetraethylenepentamine and tall oil fatty acid which was prepared substantially according to the following manner: tetraethylenepentamine was reacted with tall oil fatty acid in the molar ratio of 1 mole of tetraethylenepentamine to 3 moles of acid; the acid had the composition: 2.3% palmitic, 0.6% palmitoleic, 2.3% stearic, 41.0% oleic, 32.8% linoleic (cis-9,cis-12), 3.8% linoleic (cis-9, trans-11), 1.9% eicosanoic, 4.8% linoleic (trans-9, trans-11), 2.1% eicosadienoic, 2.9% eicosatrienoic and 0.9% behenic acids, the balance unknown; the temperature was maintained in the range of about 65° to 95° C. Characterization of the triamide of tetraethylenepentamine prepared as described would indicate the presence of amide groups and the absence of imidazoline groups.

A detailed description of one process for making a triamide of tetraethylenepentamine which is, in essence, the same as that employed in these Examples, is found in U.S. Pat. No. 3,894,849 at column 6, lines 35 to 63.

EXAMPLE 1

The triamide was formulated into a gasoline additive composition (Example 1) which contained 13.6% by weight of the triamide, 50% by weight of polypropylene of 800 molecular weight, 1.0% by weight of a dehaze agent based on oxyalkylenated alkylphenol, 1.1% by weight of a corrosion inhibitor based on long-chain carboxylic acids and 34.3% by weight of xylene solvent.

For comparative purposes, a gasoline additive formulation was prepared (Comparison Composition) containing 48.5% by weight of the above-described triamide; 7.3% by weight of the above-described dehaze agent; 8.0% by weight of the above corrosion inhibitor and, as solvents, 12.2% by weight of isopropanol and 24.0% by weight of xylene. The corrosion inhibitor, dehaze agent and solvent do not affect carburetor detergency and so are not particularly significant in these comparative evaluations.

The fuel used in this Example had the following inspection data:

| Fraction Recovered | ASTM Method | °C. (Nearest Whole Degree |
|---|---|---|
| | D-86 | 31 |
| 5% | | 38 |
| 10% | | 44 |
| 20% | | 56 |
| 30% | | 69 |
| 40% | | 85 |
| 50% | | 98 |
| 60% | | 109 |
| 70% | | 121 |
| 80% | | 136 |
| 90% | | 158 |
| 95% | | 178 |
| Max. Temperature | | 202 |
| Recovery, Vol. % | | 98.0 |
| Residue, Vol. % | | 1.0 |
| Gravity °API | D-287 | 63.8 |
| lb/gallon | | 6.044 |
| Specific 60/60 F | | 0.724 |
| Vapor Pressure (Reid) lb | D-323 | 12.7 |
| Gum, Existent mg/100 ml | D-381 | |
| Unwashed | | 1 |
| Washed | | 1 |
| Induction Period, Minutes | D-525 | 1440+ |
| Sulfur, Wt % | D-3120 | 0.023 |
| Hydrocarbon Types, Vol. % | D-1319 | |
| Saturates | | 72 |
| Olefins | | 4 |
| Aromatics | | 24 |

Amounts of the composition of Example 1 and the Comparison Composition were employed in the fuel to give the compositions described as Examples 2 to 5 and Comparisons A and B. Comparative carburetor detergency test results are recorded in Table 1.

TABLE 1

CARBURETOR DETERGENCY

| Ex.No/ Comp. Letter | Additive | Add. Conc. in ptb | Tri-amide ptb | Polypro-pylene ptb | Onan Rating |
|---|---|---|---|---|---|
| — | Base Fuel Only | — | — | — | 4.5 |
| — | Polypropylene M.W. = 800 | 12.5 | — | 12.5 | 5.6 |
| A | Comparison Composition | 5 | 2.5 | — | 6.2 |
| B | Comparison Composition | 7 | 3.4 | — | 6.8 |
| 2 | of Example 1 | 10 | 1.4 | 5 | 7.2 |
| 3 | of Example 1 | 15 | 2.0 | 7.5 | 7.2 |
| 4 | of Example 1 | 17.8 | 2.4 | 8.7 | 8.2 |
| 5 | of Example 1 | 25 | 3.4 | 12.5 | 8.6 |

The results show that the combination of the triamide component, (i), and the polypropylene component, (ii), provides carburetor detergency greater than expected based on results obtained with the components individually.

Referring to Table 1, polypropylene at 12.5 pound per thousand barrels (ptb) provides an increase of 1.1 in Onan rating over the base fuel. Thus, it would be expected that the addition of 8.7 ptb of polypropylene to the triamide of Comparison A would increase the Onan rating by no more than 1.1 rating units. See Example 4, however, wherein the increase is actually 2.0 rating units. Similarly, comparing Example 5 with Comparison B, instead of an expected increase in Onan rating to 7.9, the actual increase is to 8.6.

EXAMPLE 6

Substituting polyisobutylene (M.W. of 1400) in place of polypropylene in the composition of Example 1 produced an Onan rating of 6.5 at 15 ptb of additive (2.0 ptb of triamide).

EXAMPLE 7

Substituting polyisobutylene (M.W. of 1400) in place of polypropylene in the composition of Example 1 produced an Onan rating of 7.2 at 25 ptb of additive (3.4 ptb of triamide).

COMPARISONS A TO C

For comparative purposes, three commercially available gasoline additives, A, B, and C were tested for their carburetor detergency upon adding polypropylene. Additive A is believed to be a Mannich condensation product of polyisobutylphenol, formaldehyde and an amine probably treated with ethylene oxide. Additive B is believed to be an alkylsuccinimide containing about 30% of toluene and xylene solvent. Additive C is believed to be polyisobutylsuccinimide. The comparative tests were carried out as described above using the same fuel.

TABLE 2

CARBURETOR DETERGENCY
COMPARATIVE ADDITIVES ONLY

| Additive | ptb | Polypropylene (M.W. = 800) Added ptb | Onan Rating (1) Calc'd | Onan Rating (1) Found |
|---|---|---|---|---|
| Base Fuel Only | — | — | — | 4.5 |
| Base Fuel Only | — | 12.5 | — | 5.7 |
| Additive A | 7 | — | — | 6.6 |
| Additive A | 7 | 12.5 | 7.8 | 7.4 |
| Additive B | 7 | — | — | 6.4 |
| Additive B | 7 | 12.5 | 7.6 | 7.4 |
| Additive C | 7 | — | — | 6.2 |
| Additive C | 7 | 12.5 | 7.4 | 7.4 |

(1)Calculated by adding contribution of 12.5 ptb polypropylene over base fuel, i.e., 5.7 − 4.5 = 1.2 units to each additive rating at 7 ptb.

Table 2 shows that with each of the commercially available gasoline Additives A, B and C, the addition of polypropylene thereto either did not increase the Onan rating to the expected value (Additives A and B) or showed only additive effect (Additive C). In contrast, as shown above in Table 1, the addition of polypropylene to acylated poly(alkyleneamine) gives a greater than expected increase in Onan rating.

EXAMPLES 8 TO 10 (AND COMPARISONS C AND D)

The carburetor anti-icing properties of the compositions of this invention were determined by using a gasoline containing the composition and measuring the number of cycles before stalling. The test was carried out with a Chevrolet, 230 cubic inch, 6 cylinder engine. The environment of the carburetor was maintained at 4° C. and 95% relative humidity. At these conditions, essentially water-saturated cool air was drawn into the carburetor. The test consisted of running the engine on a two-part cycle, namely, 20 seconds with open throttle at an engine speed to 1600 rpm and 10 seconds with the throttle almost closed at 400 rpm (idling speed). During the test with a poor anti-icing gasoline, ice formed on the throttle plate and on the surrounding carburetor walls and caused the engine to stall by blocking the flow of air when the throttle plate was almost closed during the idling portion of the cycle. With a poor anti-icing gasoline, engine stalling occurred in about 3 to 5 cycles. The number of cycles to stall is an average of two or more tests. Generally, an additive is considered effective if it prevents stalling to about 10 cycles; an excellent anti-icing additive prevents stalling to at least 25 cycles.

The Composition of Example 1 and the Comparison Composition described previously were added to the gasoline, also described in Example 1. Results are summarized in Table 3.

TABLE 3

ANTI-ICING PERFORMANCE

| Ex.No./ Comp. Letter | Additive | ptb | Triamide ptb | Polypropylene ptb | Cycles to Stall |
|---|---|---|---|---|---|
| — | Base Fuel Only | — | — | — | 4.5 |
| — | Polypropylene M.W. = 800 | 12.5 | — | 12.5 | 6.0 |
| C | Comparison Composition | 5 | 2.5 | — | 5.4 |
| D | Comparison Composition | 7 | 3.4 | — | 9.8 |
| 8 | Composition of Ex. 1 | 10 | 1.4 | 5 | 6.8 |
| 9 | Composition of Ex. 1 | 17.8 | 2.4 | 8.7 | 12.5 |
| 10 | Composition of Ex. 1 | 2.5 | 3.4 | 12.5 | 25+ |

Table 3 demonstrates that the addition of polypropylene to a triamide of tetraethylenepentamine and tall oil fatty acid provides anti-icing protection considerably in excess of that which is expected based on the individual performance of the components. Thus, comparing Example 10 with Comparison D, it can be seen that equal amounts (3.4 ptb) of the triamide are used in both runs and that the gasoline in Example 10 contained additionally 12.5 ptb of polypropylene. With 12.5 ptb of polypropylene, 6.0 cycles to stall are obtained or an increase of an average of 1.5 cycles over the base fuel. Thus, it would have been expected that with the addition of 12.5 ptb of polypropylene to the composition of Comparison D, the number of cycles to stall would be 11.3, i.e., 9.8+1.5. However, Example 10 shows that actually 25+ cycles (no stall in 25 cycles) was obtained.

Similarly to Example 1, wherein the effect of the addition of polypropylene to commercially available gasoline additives on carburetor detergency was determined, polypropylene was added to commercial Additives A, B, and C described previously and their anti-icing protection determined. The results are summarized below.

TABLE 4

ANTI-ICING PERFORMANCE
COMPARATIVE ADDITIVES ONLY

| Additive | ptb | Polypropylene (M.W. = 800) Added ptb | Cycles to Stall (1) Calc'd | Cycles to Stall (1) Found |
|---|---|---|---|---|
| None | — | — | — | 4.5 |
| None | — | 12.5 | — | 6.0 |
| Additive A | 7 | — | — | 5.6 |
| Additive A | 7 | 12.5 | 7.1 | 9.2 |
| Additive B | 7 | — | — | 5.0 |
| Additive B | 7 | 12.5 | 6.5 | 7.4 |
| Additive C | 7 | — | — | 4.2 |
| Additive C | 7 | 12.5 | 6.7 | 5.8 |

(1)Calculated by adding contribution of 12.5 ptb polypropylene over base fuel, i.e., 6.0 − 4.5 = 1.5 cycles to each additive rating at 7 ptb.

The results in Table 4 show that the addition of 12.5 ptb of polypropylene to Additives A and B provide a small increase in cycles to stall over the calculated, but that with Additive C, the number of cycles to stall is actually less than expected. The small increases in the number of cycles to stall with Additives A and B are to be contrasted with the results obtained with the composition of Example 10 wherein the increase in the number of cycles to stall was more than 15.

EXAMPLES 11 to 14 (AND COMPARISONS E TO I)

Acylated poly(alkyleneamine) was prepared by reacting tetraethylenepentamine with three molar portions of a mixture of carboxylic acids comprising, by weight, 44% of palmitic acid, 20% of stearic acid, 20% of iso-stearic acid and 16% of unidentified saturated carboxylic acids according to the general procedure described in U.S. Pat. No. 3,894,849, at column 6, lines 35 to 63. This triamide, prepared from the above mixture of branched- and straight-chain saturated carboxylic acids, was formulated into a gasoline additive composition (Composition of Example 11) which contained, by weight, 13.6% of triamide, 50% of polypropylene of 800 molecular weight, 1% of dehaze agent based on oxyalkylenated alkylphenol, 1.1% of corrosion inhibitor based on long-chain carboxylic acids and 34.3% of xylene solvent.

For comparative purposes, a gasoline additive formulation was prepared containing, by weight, 48.5% of the triamide, 7.3% of the dehaze agent, 8.0% of the corrosion inhibitor and, as solvents, 12.2% of isopropanol and 24.0% of xylene.

The formulations were tested for anti-icing performance in the gasoline described supra by the procedure described supra, with the results summarized in Table 5.

TABLE 5

| Anti-Icing Performance | | | | | |
|---|---|---|---|---|---|
| Ex.No./ Comp. Letter | Additive | ptb | Tri-amide ptb | Polyprop-ylene ptb | Cycles to Stall |
| — | Base Fuel Only | — | — | — | 4.5 |
| — | Polypropylene M.W. = 800 | 12.5 | — | 12.5 | 6.0 |
| E | Comparison | 12.5 | 6.1 | — | 6.2 |
| F | Comparison | 25 | 12.1 | — | 9.6 |
| G | Comparison | 37.5 | 18.2 | — | 12.4 |
| H | Comparison | 50 | 24.2 | — | 19.2 |
| I | Comparison | 162.5 | 78.8 | — | 25+ |
| 12 | Composition of Ex. 11 | 25 | 3.4 | 12.5 | 10.2 |
| 13 | Composition of Ex. 11 | 50 | 6.8 | 25.0 | 13.2 |
| 14 | Composition of Ex. 11 | 75 | 10.2 | 37.5 | 25+ |

The results summarized in Table 5 show that polypropylene which exhibits very little anti-icing protection when used alone provides enhanced anti-icing performance when combined with the acylated poly(alkyleneamine). Thus, a gasoline composition which contains 3.4 ptb of the acylated polyamine and 12.5 ptb of polypropylene is an effective anti-icing gasoline since such a gasoline prevents stalling to 10 cycles. When used at a concentration of 10.2 ptb of the triamide and 37.5 ptb of the polypropylene, the composition provides excellent anti-icing performance.

EXAMPLES 15 TO 18 (AND COMPARISONS J TO M)

This Example illustrates equivalent enhancement of carburetor anti-icing performance when polyisobutylene is used in combination with acylated poly(alkyleneamine). The acylated poly(alkyleneamine) was the triamide of Example 1. The icing test used was that described heretofore. The gasoline used had the following inspection data.

| Fraction Recovered | ASTM | ° C. to nearest whole degree |
|---|---|---|
| | D-86 | |
| | | 25 |
| 5% | | 31 |
| 10% | | 36 |
| 20% | | 44 |
| 30% | | 53 |
| 40% | | 62 |
| 50% | | 73 |
| 60% | | 89 |
| 70% | | 112 |
| 80% | | 139 |
| 90% | | 162 |
| 95% | | 178 |
| Max. Temp. | | 197 |
| Recovery, Vol. % | | 98.5 |
| Residue, Vol. % | | 1.0 |
| Gravity API | D-287 | 68.8 |
| Specific 60/60 F | | 0.706 |
| Vapor Pressure (Reid) lbs | D-323 | 15.0 |
| Gum, Existent mg/ 100 ml | D-381 | |
| Unwashed | | 2 |
| Washed | | 2 |
| Induction Period, Minutes | D-525 | 1440+ |
| Sulfur, Wt. % | D-3120 | 0.024 |
| Hydrocarbon Types | D-1319 | |
| Saturates, Vol. % | | 70 |
| Olefins, Vol. % | | 10 |
| Aromatics, Vol. % | | 20 |

The anti-icing performance results are summarized in Table 6.

TABLE 6

| ANTI-ICING PERFORMANCE | | | | |
|---|---|---|---|---|
| Ex. No./ Comp. Letter | Triamide Conc. ptb | Polyisobutylene M.W. | Polyisobutylene ptb | Cycles to Stall |
| — | — | — | — | 4.0 |
| — | 3.4 | — | — | 10.2 |
| J | — | 730 | 12.5 | 6.4 |
| 15 | 3.4 | 730 | 12.5 | 25+ |
| K | — | 1400 | 12.5 | 6.0 |
| 16 | 3.4 | 1400 | 12.5 | 25+ |
| L | — | 1400 | 10.0 | 5.5(1) |
| 17 | 2.7 | 1400 | 10.0 | 15.2 |
| M | — | 2500 | 12.5 | 5.0 |
| 18 | 3.4 | 2500 | 12.5 | 25+ |

(1)Interpolated from Comparison K.

The results of Table 6 demonstrate that polyisobutylene enhances the anti-icing performance of acylated poly(alkyleneamine). In each case the increase in the number of cycles to stall is considerably in excess of what one would expect based on the individual performances of the components of the combination.

EXAMPLES 19 TO 25

The acylated poly(alkyleneamine) described in Example 1,polypropylene, dehaze agent, corrosion inhibitor and xylene solvent were formulated into the following gasoline additive compositions wherein the ratios of polypropylene to the acylated poly(alkyleneamine) were varied.

| Components | Ex. Compositions (% by wt.) | | | |
|---|---|---|---|---|
| | Ex. 1 | Ex. 19 | Ex. 20 | Ex. 21 |
| Acylated Poly-(alkyleneamine) | 13.6 | 11.2 | 8.5 | 6.8 |
| Dehaze Agent | 1.0 | 1.0 | 1.0 | 1.0 |
| Corrosion Inhibitor | 1.1 | 1.1 | 1.1 | 1.1 |
| Polypropylene | 50.0 | 56.5 | 64.0 | 68.6 |
| Xylene | 34.3 | 30.2 | 25.4 | 22.5 |
| Polymer/Acylated Poly(alkyleneamine) Ratio | 3.6 | 5.0 | 7.5 | 10.0 |

The induction system deposit (ISD) tests were carried out by the modified bench tests of Johnston and Dimitroff, SAE Transactions, Vol. 75 (1967), Paper No. 660,783. Good correlation between the results obtained by this test and the tendency of motor gasolines to form deposits in the induction systems of spark-ignition engines is well known. The test consists of spraying gasoline and air onto a heated preweighed metal tube. At the conclusion of the test, the metal tube is removed from the apparatus, washed with heptane and weighed. The weight of the deposit to the nearest 0.1 mg indicates the deposit-forming tendency of the fuel. The following test conditions were used:

| | |
|---|---|
| Fuel: | 100 ml Indolene containing 10 volume percent of 10% Indolene distillation bottoms and 0.05 volume percent of used crankcase oil ("Uniflo," 3300 miles) |
| Fuel Flow: | 2 cc/min |
| Air Flow: | 0.05 cu ft/min |
| Billet Temperature: | 288° C. |

The effects of the compositions on the induction system deposits were determined by adding the compositions in the indicated amounts to the above-described fuel and determining the amount of the deposit formed. Results are shown in Table 7.

TABLE 7

INDUCTION SYSTEM DEPOSIT WEIGHT

| Ex. No. | Additive | ptb | Acylated poly(alkyleneamine) ptb | Polypropylene ptb | Deposit Weight mg. |
|---|---|---|---|---|---|
| — | Base Fuel Only | — | — | — | 2.0 |
| 22 | of Example 1 | 25 | 3.4 | 12.5 | 2.5 |
| | | 125 | 17.0 | 62.5 | 3.0 |
| | | 250 | 34.0 | 125.0 | 3.0 |
| 23 | of Example 19 | 25 | 2.8 | 14.1 | 2.5 |
| | | 125 | 14.0 | 70.5 | 2.3 |
| | | 250 | 28.0 | 141.0 | 5.3 |
| 24 | of Example 20 | 25 | 2.1 | 16.0 | 2.6 |
| | | 125 | 10.6 | 80.0 | 2.8 |
| | | 250 | 21.2 | 160.0 | 4.2 |
| 25 | of Example 21 | 25 | 1.7 | 17.1 | 2.7 |
| | | 125 | 8.5 | 85.5 | 3.4 |
| | | 250 | 17.0 | 171.0 | 3.4 |

The results summarized in Table 7 indicate that the compositions of this invention containing varying ratios of the hydrocarbon polymer and acylated poly(alkyleneamine) increase induction system deposits very little. The use of a top cylinder oil, i.e., a paraffinic or naphthenic oil having a viscosity at 100° F. of about 500 to 3500 SUS, with the compositions of this invention can be expected to be effective in minimizing or controlling the amount of induction system deposits.

The embodiments of the invention in which an exclusive property or privilege is claimed are defined as follows:

1. A gasoline additive composition comprising (i) a hydrocarbon-soluble, acylated, poly(alkyleneamine) of the formula $$R^1-\overset{\overset{\displaystyle O}{\|}}{C}-\overset{\overset{\displaystyle H}{|}}{N}-(C_nH_{2n}\overset{\overset{\displaystyle R}{|}}{N})_xH$$

wherein

R is selected from at least one of H and R'—C(O)—;

$R^1$ is $C_9$ to $C_{23}$ hydrocarbyl;

n is 2, 3, or a mixture of 2 and 3; and x is 2 to 6; and (ii) from about 1 to 10 parts per part of said poly(alkyleneamine) of a normally liquid, hydrocarbon-soluble polymer of a $C_2$ to $C_6$ olefin, said polymer having an average molecular weight of about 400 to 3000.

2. A composition according to claim 1 wherein at least two R groups are R'—C(O)—.

3. A composition according to claim 2 wherein the poly(alkyleneamine) is a triamide of tetraethylenepentamine and tall oil fatty acid.

4. A composition according to claim 2 wherein the poly(alkyleneamine) is a triamide of tetraethylenepentamine and mixed, saturated branched- and straight-chain carboxylic acid.

5. A composition according to claim 2 wherein R' is a $C_9$ to $C_{21}$ hydrocarbyl, n is 2 or 3, x is 4 and the polymer is polypropylene.

6. A composition according to claim 5 wherein the polypropylene has an average molecular weight of about 500 to 1000 and is present in an amount of about 3 to 8 parts of said polymer per part of poly(alkyleneamine).

7. A composition according to claim 6 wherein the poly(alkyleneamine) is a triamide of tetraethylenepentamine and tall oil fatty acid.

8. A composition according to claim 6 wherein the poly(alkyleneamine) is a triamide of tetraethylenepentamine and mixed, saturated branched- and straight-chain carboxylic acid.

9. A composition according to claim 2 wherein R' is a $C_9$ to $C_{21}$ hydrocarbyl, n is 2 or 3, x is 4 and the polymer is polyisobutylene.

10. A composition according to claim 9 wherein the polyisobutylene has an average molecular weight of about 950 to 1400 and is present in an amount of about 3 to 8 parts of said polymer per part of poly(alkyleneamine).

11. A composition according to claim 10 wherein the poly(alkyleneamine) is a triamide of tetraethylenepentamine and tall oil fatty acid.

12. A composition according to claim 10 wherein the poly(alkyleneamine) is a triamide of tetraethylenepentamine and mixed, saturated branched- and straight-chain carboxylic acid.

13. A gasoline additive composition comprising from 30% to 75% by weight of the composition of claim 1 and from 25% to 70% by weight of a hydrocarbon solvent.

14. A fuel composition comprising gasoline and an effective amount of the additive composition of claim 1 to provide carburetor detergency in spark-ignition engines.

15. A composition according to claim 14 comprising an amount of about 0.0004 to 0.04 weight percent of poly(alkyleneamine) based on the gasoline, and from 0.0004 to 0.2 weight percent of the polymer based on the gasoline.

* * * * *